US005509602A

United States Patent [19]

Liu

[11] Patent Number: 5,509,602

[45] Date of Patent: Apr. 23, 1996

[54] SAVINGS BANK WITH MUSIC BELL

[76] Inventor: Jian H. Liu, No. 2, Alley 202, Kao Fen Rd., Hsin-Chu City, Taiwan

[21] Appl. No.: 277,304

[22] Filed: Jul. 22, 1994

[51] Int. Cl.[6] ..... A45C 1/12

[52] U.S. Cl. ..... 232/7; 446/9; D99/35; 84/95.1

[58] Field of Search ..... 232/7, 9, 55, 57; D99/35, 36; 84/94.2, 95.1, 95.2; 446/268, 9

[56] References Cited

U.S. PATENT DOCUMENTS

| | | | |
|---|---|---|---|
| 2,800,825 | 7/1957 | Toussaint | 84/94.2 |
| 3,149,525 | 9/1964 | Marder | 84/95.1 |
| 3,170,359 | 2/1965 | Mourra | 84/94.2 |
| 5,255,461 | 10/1993 | Chiou | 84/94.2 |
| 5,342,988 | 8/1994 | Hsu et al. | 84/95.1 |

*Primary Examiner*—Michael J. Milano
*Attorney, Agent, or Firm*—Larson and Taylor

[57] ABSTRACT

A savings bank with a music bell is disclosed and comprises a control stick, a control lamella and other components. The locating end of the control stick and the control lamella is rotated by a coin deposited in the guide rail, and is located so as to lock the fly wheel again after the drive gear installed on the music bell has rotated by one revolution.

13 Claims, 6 Drawing Sheets

SAVINGS BANK WITH MUSIC BELL

DESCRIPTION OF THE PRIOR ART

The present invention relates in general to savings boxes or banks, and relates in particular to a coin bank that generates a sound upon the depositing of a coin.

The conventional structure of a savings bank contains a coin slot so that a coin deposited into the slot is stored inside the bank. Such structure provides no additional object but saving money, so the intention of consumption is increased by many designs which provide the conventional savings bank with various sound and light effects.

SUMMARY OF THE INVENTION

Because of the deficiencies in the prior art, the present inventor having a lot of experience in the design of artistic adornments in which the music is performed from a reed music bell driven by a spring, developed a savings bank with a musical bell. The bank especially has a characteristic that the operation thereof is controlled by the power of itself and the weight of the coins. A main object of the aforementioned structure is to inspire the user by the musical sound of the music bell performed by a mechanical movement or action caused by coins being deposited in the savings bank.

The present invention offers a savings bank with a music bell, especially in the characteristic that the operation thereof is controlled by the power of itself and the weight of the coins. The bank comprises a control stick, a control lamella and other components. By locating the end of the control stick and the control lamella, the control stick is rotated and is positioned by the coins deposited in the guide rail so as to lock the fly wheel again after the drive gear installed on the music bell is rotated by one revolution or circle.

DETAIL DESCRIPTION OF THE INVENTION

Further details of the advantageous features and effects of the invention will more readily be understood from the detailed description rendered in association with the accompanying drawings in which like elements throughout the several views have a similar designation.

Figure 1:
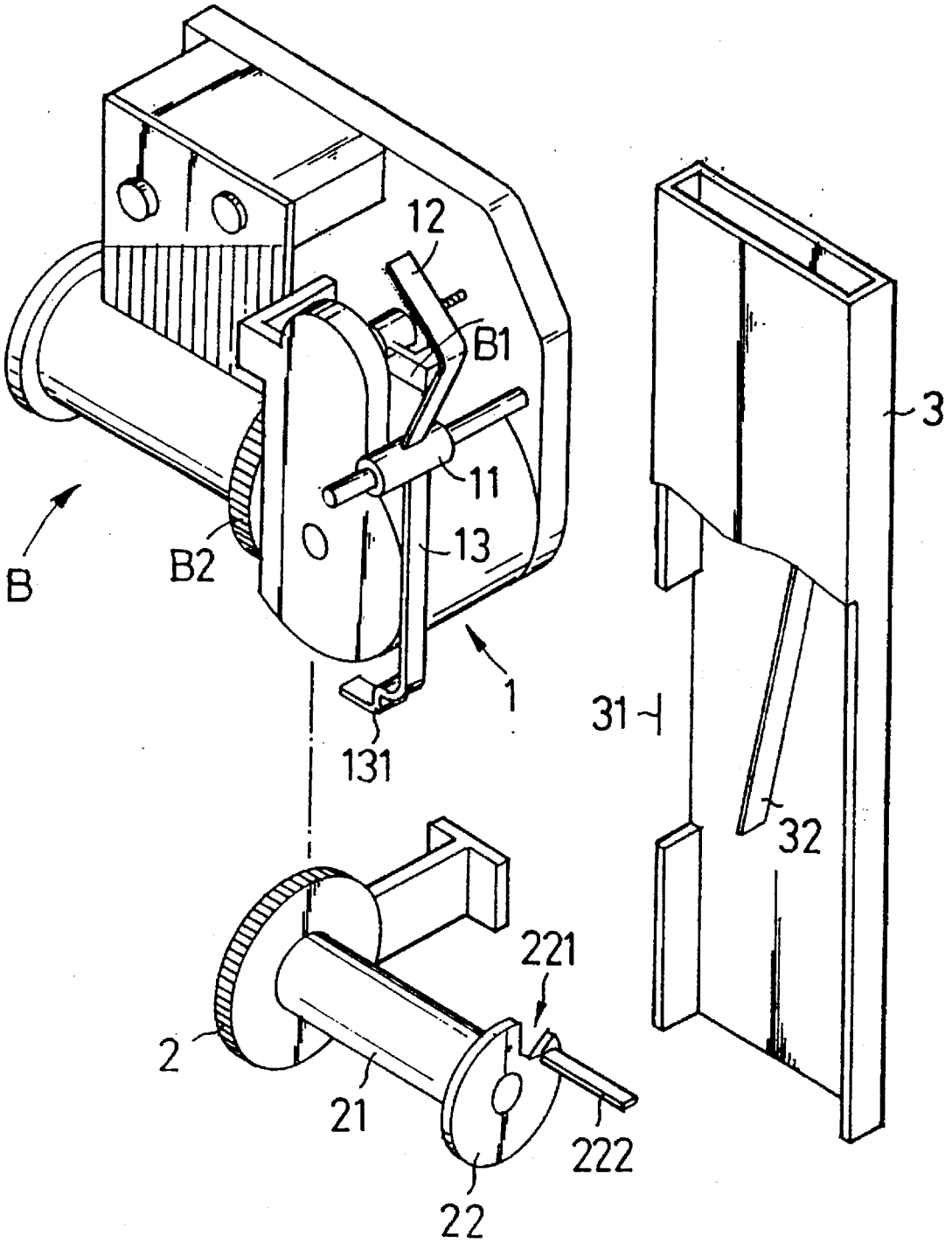
FIG. 1 shows a perspective view of the construction according to the invention including a music bell, a control lamella and a guide rail.
Figure 2:
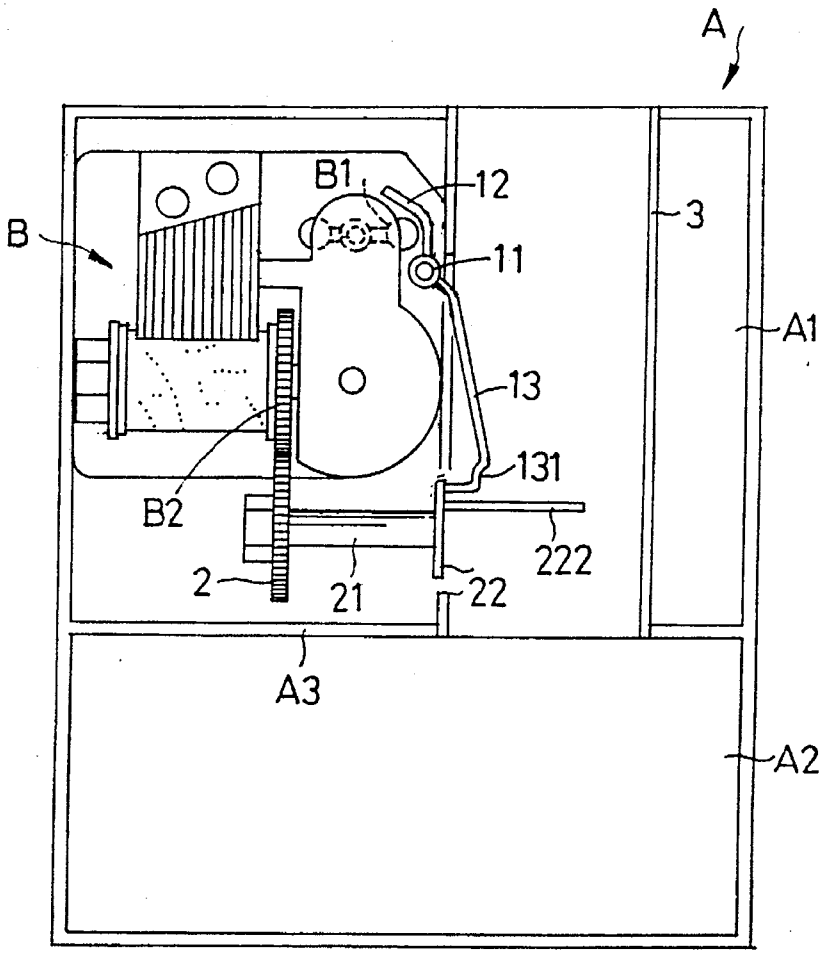
FIG. 2 shows a sectional view of the invention before activation of the mechanism.
Figure 3:
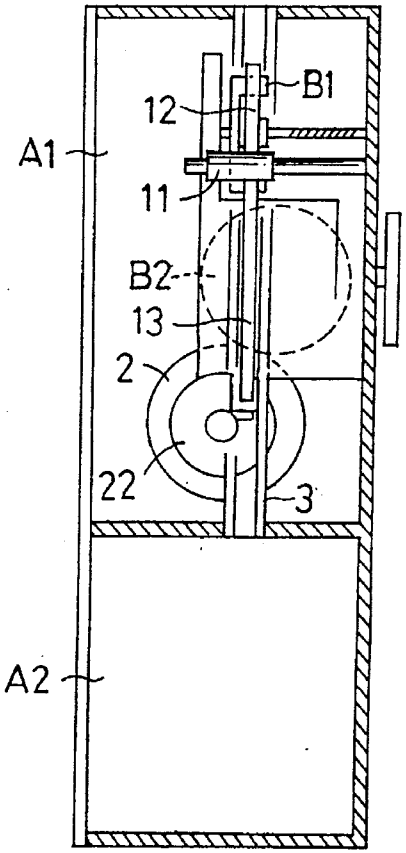
FIG. 3 shows a lateral sectional view of the invention.

As shown in FIGS. 1, 2 and 3, there is depicted a savings bank A. Any possible shape of the savings bank A is acceptable, and a simple square box is represented in the present embodiment. Savings bank A is separated into an upper chamber A1 and a lower chamber A2 by a division plate A3. Lower chamber A2 is used to store deposited coins.

A music bell B driven by a slowly unwinding spring is mounted on the wall of upper chamber A1. The slow release of the power from the spring is controlled by the rotational resistance of a fly wheel B1. In this way the wonderful music produced by the disturbed flap is performed by the rotating music bell B at a normal velocity.

A plate like control stick 1 longitudinally installed near the fly wheel B1 defines a stop 12 and a contact end 13 above and below a pivot 11 respectively. A locating end 131 is defined below contact end 13. Stop 12 of control stick 1 can be kept in contact with the fly wheel B1 by the elasticity of a spring [not shown in diagram] or the force of gravity resulting from the weight thereof. Fly wheel B1 is then held in a stopped condition and the release of the spring power on the music bell B is disabled.

A longitudinal guide rail 3 is installed on the relative side of the control stick 1. Guide rail 3 has an upper and a lower side, the former being on the upper surface of the savings bank A and the later being connected to the lower chamber A2. A coin C is deposited in the guide rail 3 and is stored in the lower chamber A2. An aperture 31 relative to contact end 13 of control stick 1 is formed on guide rail 3. In this way contact end 13 of control stick 1 can be extended to the dropping path of coin C in guide rail 3. A sloping spring leaf 32 is mounted inside guide rail 3 so that coins C with different diameters are pushed to contact contact end 13.

A follower gear 2, driven by drive gear B2, is installed below drive gear B2 of the music bell. A revolving shaft 21 extended from follower gear 2 to control stick 1 is also installed with a circular control lamella 22 on the end. A notch 221 through which the locating end 131 can pass is formed with respective to the locating end 131 of the control stick, and a damper 222 installed on the control lamella 22 is extended into the dropping path of coin C in guide rail 3.

Figure 5A:
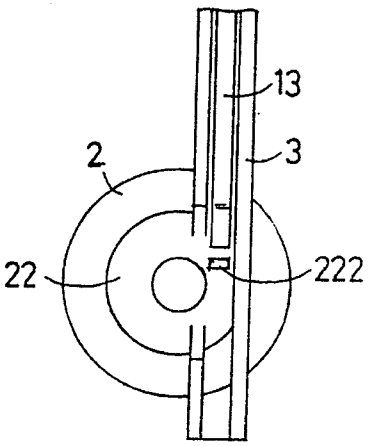
FIGS. 5(*a*), (*b*) and (*c*) are schematic diagrams of the control stick and the control lamella in the free condition.
Figure 5B:
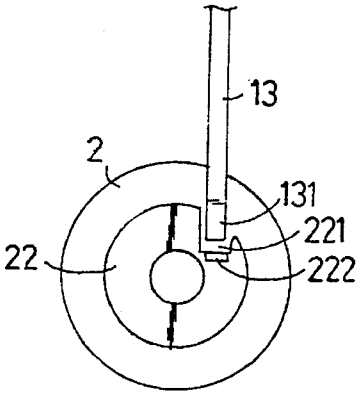
Figure 5C:
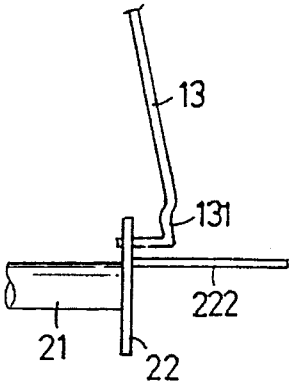

The whole structure of the invention will be better understood from the description above, when the embodiment is in the beginning state or free condition, i.e., before a coin c has been deposited in guide rail 3. In this condition, fly wheel B1 is retained in the stopped state, contact end 12 is extended into the dropping path of the coin C, and the terminal of locating end 131 is outside notch 221 of control lamella 22, as shown in FIGS. 2 and 5. Meanwhile, damper 222 of control lamella 22 is also on the dropping path of coin C.

Figure 4:
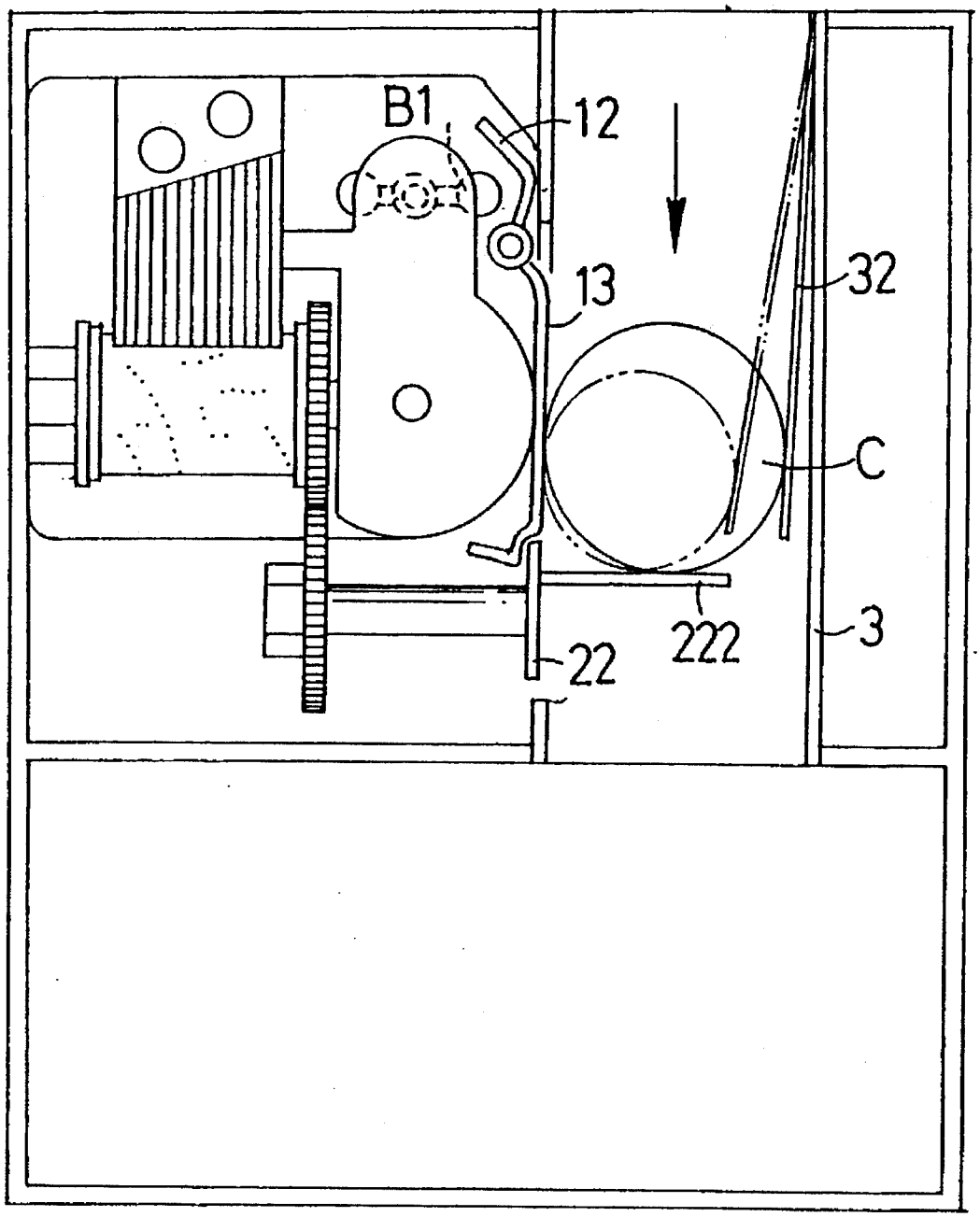
FIG. 4 is a sectional view similar to FIG. 2 and depicting the activation of a control stick shown at rest in FIG. 2. pushed to rotate by the coin.
Figure 6A:
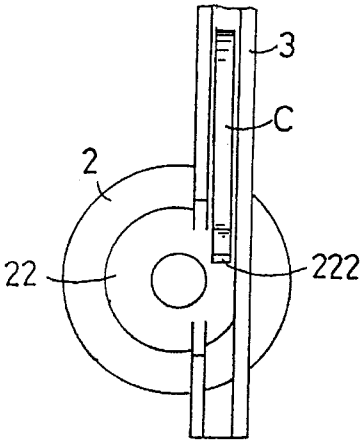
FIGS. 6(*a*), (*b*) and (*c*) are schematic diagrams similar to FIGS. 5(*a*), 5(*b*) and (*c*), and show the position of the control stick relative to the control lamella when pushed to rotate by a coin.
Figure 6B:
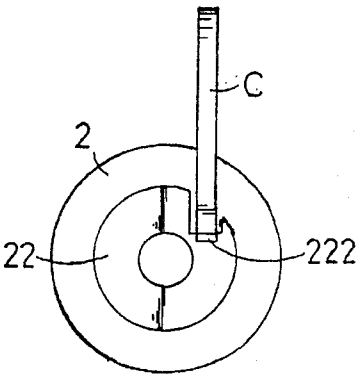
Figure 6C:
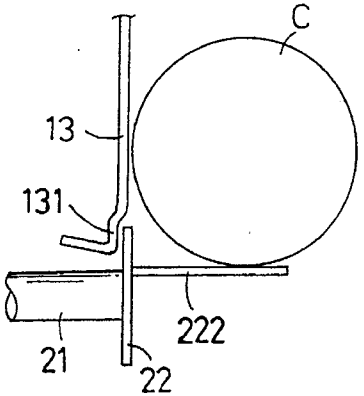

When a coin C is deposited in guide rail 3 by a user, it will drop down by the gravity, but is blocked by damper 222 on control lamella 22. Coin C pushes contact end 13 to rotate control stick 1 by an angle and moves locating end 131 to the inside of control lamella 22 through notch 221. Thereupon, fly wheel B2 is disengaged from the confinement of stop 12, as shown in FIGS. 4 and 6, and the music bell begins to emit sound as control lamella 22 is rotated in the clockwise direction by drive gear B2.

The elasticity of the spring or the gravity of the weight which position control stick 1 in the free condition must be smaller than the gravity of coins C so as to rotate control stick 1.

In the present embodiment, coins C deposited in guide rail 3 can have different diameters. A spring leaf 32 is mounted in guide rail 3 so as to push coin C with smaller diameter to a position where it can rotate control stick 1, as shown in FIG. 4.

Figure 7A:
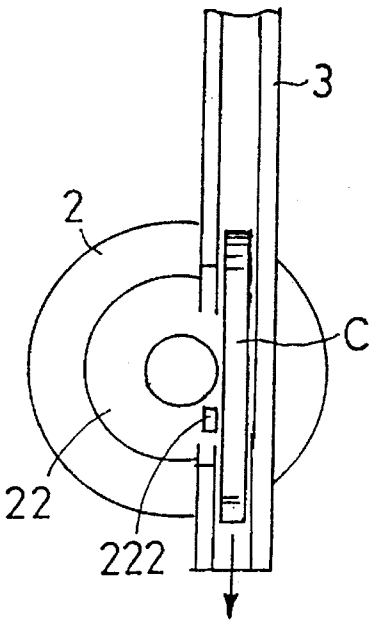
FIGS. 7(*a*), (*b*) and (*c*) are schematic diagrams similar to FIGS. 5(*a*), 5(*b*) and (*c*), and show the position of the control lamella relative to the control stick when rotated to the position where a coin can drop down.
Figure 7B:
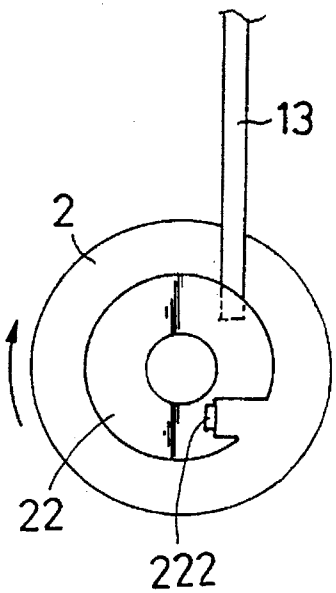
Figure 7C:
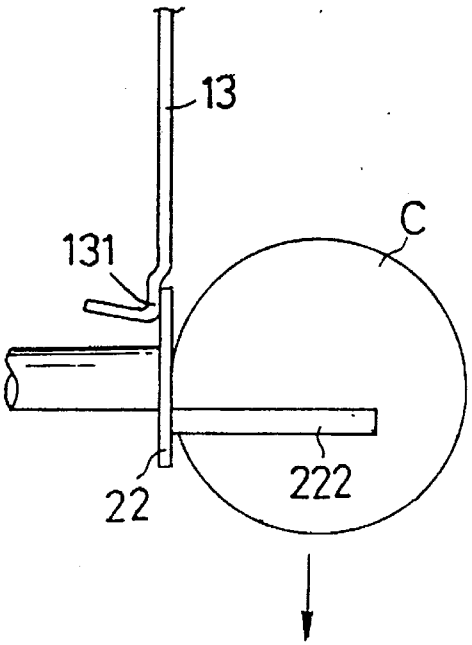

Because fly wheel B1 on the music bell has disengaged from the constraint of stop 12, the music bell continually emits sound due to the power of the spring, i.e., control lamella 22 continually rotates clockwise. When damper 222 on control lamella 22 is deviated from the dropping path of coins C in guide rail 3, notch 221 is also deviated from the original position, so the coins can drop into the lower chamber A2 of savings bank A. Meanwhile, because control lamella 22 confines locating end 131 of control stick 1 to remain inside control lamella 22, as shown in FIG. 7, music bell B can operate continuously.

As music bell B rotates continuously, notch 221 of control lamella 22 returns to the original position relative to locating end 131 of control stick 1. Because no coin C is present in guide rail 3, control stick 1 can be rotated to the original position of the free condition by the elasticity, and stop 12 is in contact with fly wheel B1 again to stop music bell B.

From the operation of aforementioned structure, each coin C permits drive gear B2 of music bell B to rotate by only one revolution. In accordance with the practical operation of a model of the present invention, after the music bell has been wound, the power of the spring is enough to rotate effectively drive gear B2 from five to seven revolutions. Thus coin C can be deposited into guide rail 3 from five to seven times with one winding.

The control lamella 22 of the embodiment described hereinabove is rotated synchronistically with follower gear 2. The coins C deposited in guide rail 3 are supported by damper 222 and stay in guide rail 3 until damper 222 is deviated from the dropping path of coin C. During this time, too many coins can not be simultaneously present in guide rail 3, so the coins must be divided into groups and be deposited in guide rail 3.

Figure 8B:
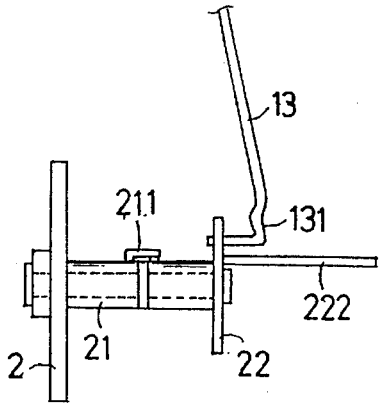
FIGS. 8(*a*) and (*b*) are schematic diagrams of alternative embodiments of the control lamella and the revolving shaft in a slack condition caused by a disengagement or disconnection between them.
Figure 8A:
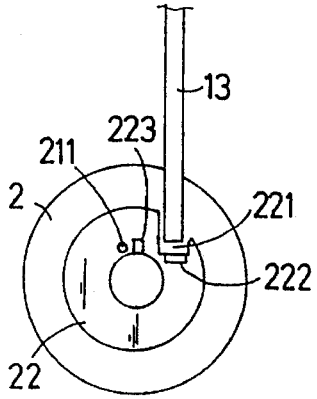

To overcome this inconvenience, an alternative embodiment comprising a split revolving shaft 21 with follower gear 2 mounted on one end and control lamella 22 mounted on the other end is shown in FIG. 8. Control lamella 22 is shown in the slack condition in which it is disconnected from revolving shaft 21, which has a convex block 223 and a driving block 211 mounted on the circumferences thereof respectively.

In the alternative embodiment described hereinabove, when no coin C is deposited in guide rail 3, control stick 1 is in the free condition. The terminal of control stick locating end 131 is at the location of notch 221, which insures that slack control lamella 22 is located so as to prevent control stick 1 from being rotated by control lamella 22 as a result of the rotation produced by the vibration and other factors.

As coin C is deposited in guide rail 3, coin C first pushes contact end 13 to rotate control stick 1 by an predetermined angle and to move locating end 131 to inside of control lamella 22. This will remove the confinement of locating end 131 on control lamella 22. Then coin C pushes damper 222 to rotate so that it can drop into lower chamber A2 of savings bank A.

Figure 9B:
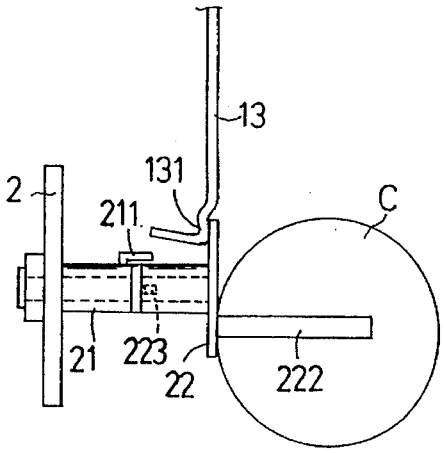
FIGS. 9(*a*) and (*b*) are schematic diagrams of the control lamella pushed by a coin when the control stick in FIG. 8. is pushed to rotate by the coin.
Figure 9A:
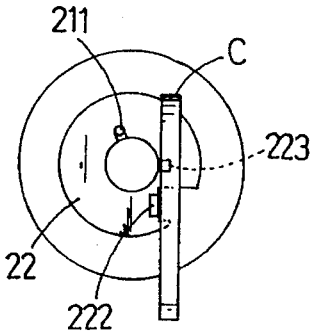

FIG. 9 shows the rotation of control lamella 22 pushed by coin C. Notch 221 moves away from the original position, which remain locating end 131 to stay in the longitudinal position by the confinement of control lamella 22. Therefore, instead of being stopped in guide rail 3, coin C can drop into lower chamber A2 directly, so the operation of many coins C in each time is acceptable.

Figure 10B:
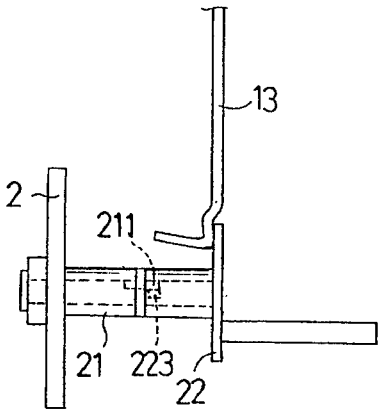
FIGS. 10(*a*) and (*b*) are schematic diagrams of the control lamella in FIG. 9. driven to rotate synchronistically by the revolving shaft.
Figure 10A:
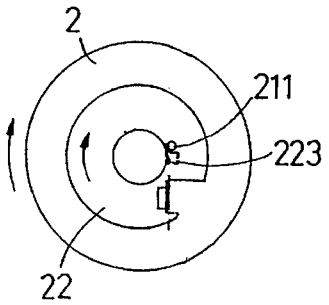

Because fly wheel B1 of the music bell has been disengaged from confinement of stop 12, follower gear 2 is driven to rotate, i.e., driving block 211 of said revolving shaft 21 rotates clockwise. When driving block 211 rotates to a position of convex block 223 on control lamella 22, as shown in FIG. 10, static control lamella 22 is driven to rotate synchronistically by the contact of convex block 223 between them. As notch 221 of control lamella 22 is rotated again to the previous position relative to control stick locating end 131, control stick 1 is rotated to the original position of the free condition by the elasticity, and stop 12 is in contact with fly wheel B1 to stop music bell B again.

Summarizing the foregoing description, by the locating end of the control stick and the control lamella, the control stick is rotated and is located through the coin deposited in the guide rail to lock the fly wheel again after the drive gear installed on the music bell rotates by one revolution.

What is claimed is:

1. A savings bank with a music bell having a fly wheel and a drive gear and operated by depositing a coin, the bank comprising:

a housing;

a guide rail mounted on said housing and defining a dropping path;

a control stick with a stop and a contact end mounted near the side of the fly wheel on the music bell, so that in the free condition before a coin is deposited, the contact end is extended into the dropping path of the coin in the guide rail, and the stop prevents said fly wheel from rotating;

said control stick being mounted such that said contact end could be pushed to rotate by a coin deposited in the guide rail, thereby disengaging the fly wheel from the confinement of the stop;

a revolving shaft;

a follower gear mounted on one end portion of said revolving shaft and driven by the drive gear of the music bell;

a control lamella having a notch is mounted on the other end portion of said revolving shaft at a position relative to the locating end of the control stick so that when in the free condition said locating end is located at the end of the revolving shaft, and when said contact end is pushed to rotate by a coin, the locating end can move to the inside of the control lamella through the notch so that the control stick is limited to return to the original free position after the control lamella rotates; and a damper mounted on said control lamella so that it can be extended into the dropping path of the coin in the guide rail.

2. The structure as claimed in claim 1, wherein the force from the elasticity of a spring connected to said control stick and the force of gravity resulting from the weight of said stop is smaller than the force of gravity resulting from the weight of the coin.

3. The structure as claimed in claim 1, wherein the free condition of said control stick is formed by the elasticity of a spring connected to said control stick.

4. The structure as claimed in claim 3 wherein the force from the elasticity of a spring connected to said control stick is smaller than the force of gravity resulting from the weight of the coin.

5. The structure as claimed in claim 3, wherein said control stick is pivotally mounted about a pivot, said stop being located above said pivot and said contact end being located below said pivot; and wherein the free condition of said control stick is formed by the force of gravity resulting from the weight of that portion of said control stick above said pivot.

6. The structure as claimed in claim 5, wherein the forge of gravity resulting from the weight of said stop is smaller than the force of gravity resulting from the weight of the coin.

7. The structure as claimed in claim 1, wherein said housing has an upper surface and is divided into an upper chamber and a lower chamber; and wherein said guide rail has an upper side that is on the upper surface of the saving bank, and a lower side that is in communication with the lower chamber.

8. The structure as claimed in claim 1, wherein a spring leaf which can push the coin to contact the contact end is installed in one side of said guide rail.

9. The structure as claimed in claim 1, wherein said control lamella is in slack condition formed by disconnection with said revolving shaft.

10. The structure as claimed in claim 9, wherein a coin dropped into said guide rail can push said damper, thereby rotating said control lamella.

11. The structure as claimed in claim 9, wherein the revolving shaft is split into a driving first portion on which said follower gear is mounted and a driven second portion on which said lamella is mounted; and further comprising a driving block mounted on said first portion of said revolving shaft and a convex block mounted on said second portion of said revolving shaft such that said first portion can rotate to the position of and contact the convex block on said control lamella, whereupon the previously stationary control lamella is then driven to rotate synchronously with said driving block by the contact between them.

12. The structure as claimed in claim 9, wherein the terminal portion of said locating end is positioned in said notch of the control lamella so as to prevent rotation of said control lamella when said control stick is in the free condition.

13. The structure as claimed in claim 1, wherein the terminal portion of said locating end is positioned in said notch of the control lamella so as to prevent rotation of said control lamella when said control stick is in the free condition.

* * * * *